US008910826B2

(12) United States Patent
Rapala

(10) Patent No.: US 8,910,826 B2
(45) Date of Patent: Dec. 16, 2014

(54) SHEETED CLEANING MEDIA DISPENSER WITH ROTATION LIMITING HANGER

(76) Inventor: Gregg R. Rapala, Arlington Heights, IL (US)

( * ) Notice: Subject to any disclaimer, the term of this patent is extended or adjusted under 35 U.S.C. 154(b) by 327 days.

(21) Appl. No.: 12/660,913

(22) Filed: Mar. 8, 2010

(65) Prior Publication Data

US 2010/0243669 A1 Sep. 30, 2010

Related U.S. Application Data

(60) Provisional application No. 61/211,239, filed on Mar. 27, 2009.

(51) Int. Cl.
*A47K 10/24* (2006.01)
*B65H 1/00* (2006.01)

(52) U.S. Cl.
USPC ..... 221/45; 221/34; 221/33; 221/282; 221/133; 221/18; 221/309; 221/38; 242/598.5; 242/55.53; 242/595; 222/180; 248/340; 206/233

(58) Field of Classification Search
CPC ..... B65D 83/0805; B65D 83/0894; A47K 2010/3266; A47K 2010/3818; A47K 10/421; A47K 10/424; A47K 10/3818; A47K 10/46; A47K 10/24; A47K 2201/00
USPC ..... 221/45, 282, 34, 133, 48, 309, 38, 33; 242/598.5, 55.53, 595; 222/180; 248/340; 206/233
See application file for complete search history.

(56) References Cited

U.S. PATENT DOCUMENTS

| | | | | |
|---|---|---|---|---|
| 2,685,365 | A * | 8/1954 | Sieven | 206/410 |
| 3,409,340 | A * | 11/1968 | Clark | 312/34.8 |
| 3,837,595 | A * | 9/1974 | Boone | 242/594.5 |
| 4,427,159 | A * | 1/1984 | Miller et al. | 242/560 |
| 4,798,312 | A * | 1/1989 | Scheiber | 222/180 |
| 4,964,543 | A * | 10/1990 | Scheiber | 222/180 |
| 5,311,986 | A * | 5/1994 | Putz | 206/233 |
| 5,897,074 | A * | 4/1999 | Marino | 242/594.1 |
| 5,950,960 | A * | 9/1999 | Marino | 242/594.5 |
| 6,382,552 | B1 * | 5/2002 | Paul et al. | 242/595 |
| 6,439,386 | B1 * | 8/2002 | Sauer et al. | 206/494 |
| 6,929,148 | B2 * | 8/2005 | Haddad et al. | 221/45 |
| 6,976,605 | B2 * | 12/2005 | Mitchell et al. | 221/45 |
| 6,997,342 | B2 * | 2/2006 | Mitchell et al. | 221/45 |
| 7,040,502 | B2 * | 5/2006 | Phelps et al. | 221/34 |
| 7,128,235 | B2 * | 10/2006 | Haddad et al. | 221/45 |
| 7,147,129 | B1 * | 12/2006 | Menefield | 221/283 |
| 7,207,461 | B2 * | 4/2007 | Mitchell et al. | 221/45 |
| 7,430,886 | B2 * | 10/2008 | Zeusnik | 68/205 R |
| 7,481,395 | B2 * | 1/2009 | Rogers | 242/594.5 |
| 7,726,513 | B2 * | 6/2010 | Schlaupitz et al. | 221/45 |
| 2002/0092749 | A1 * | 7/2002 | Iida | 200/343 |
| 2002/0092789 | A1 * | 7/2002 | Sauer et al. | 206/494 |
| 2003/0192903 | A1 * | 10/2003 | Sauer et al. | 221/48 |
| 2004/0245266 | A1 * | 12/2004 | Mitchell et al. | 221/33 |
| 2006/0214048 | A1 * | 9/2006 | Sucher | 242/598.5 |
| 2007/0045334 | A1 * | 3/2007 | Sherman et al. | 221/38 |
| 2012/0305588 | A1 * | 12/2012 | Gerschwiler Steck et al. | 221/133 |

* cited by examiner

*Primary Examiner* — Gene O. Crawford
*Assistant Examiner* — Rakesh Kumar

(57) ABSTRACT

A dispenser is described for dispensing sheeted cleaning media, such as disposable hand towels, in a residential or household setting using the existing towel bar for a means of placement.

13 Claims, 4 Drawing Sheets

SHEETED CLEANING MEDIA DISPENSER WITH ROTATION LIMITING HANGER

This application claims the benefit of Provisional Patent Application Ser. No. 61/211,239 filed Mar. 27, 2009 by the present inventor, Gregg R. Rapala.

FIELD OF THE INVENTION

This invention relates to a dispenser made for dispensing sheeted cleaning media; and in a specific application, for dispensing of paper hand towels in a residential or household setting, especially for visiting guests.

BACKGROUND OF THE INVENTION

When entertaining guests at home it is often desirable to provide special items in the home to make the guests more comfortable, and create a more desirable atmosphere than is typical otherwise. The present invention, in the presently preferred embodiment, provides clean disposable paper hand towels for guests to use after hand washing, in a fashionably designed container that can be mounted on the available towel bar currently in ones home.

For guests, standard-sized cloth towels or smaller-sized hand towels usually replace the homeowner's normal everyday towels. Rolled-up or folded cloth hand towels may be displayed in a basket on the sink counter-top. The wall-mounted paper hand towel dispensers used commercially by many businesses and in various public restrooms, are not used in the household. Paper towels described as "Buffet/Guest" towels also exist, but one must grasp one from a stack and unfold it—with wet hands! Therefore, no truly good guest hand towel (cloth or paper) exists—all require some degree of work such as washing and folding, or grasping from a stack and unfolding using wet hands. Unfortunately, with cloth towels, one is often unsure whether or not the towel has been used previously, as only a very limited number of them are usually provided for use. The present invention, in a presently preferred embodiment, places a stack of disposable hand towels near the available towel bar that exists in the home, using a container with specially designed hangers. Therefore, the present invention can conveniently provide paper hand towels designed for one time use at the towel bar, where towels are normally placed.

It should be noted that some towel bars, especially of the round bar design, may be placed at slightly different distances from a wall, as well as have different diameters of a rod. The hanger opening therefore may be an unusual shape—not fully rectangular or circular. The hanger opening in the presently preferred embodiment of the invention is an irregular shape with straight and curved sections to accommodate various towel bars, whether they be of a square or round bar design. The extended portion of the hangers that extend beyond the opening for the towel bar and opposite the container, come near the wall when hung, and aid in preventing rotation of the container by bumping up against the wall when a sheeted cleaning medium is dispensed from the container at an angle from the wall. Additionally, the pair of these extensions (as shown) along with the towel bar and wall provide for a somewhat protected "shelf" for temporary storage of items such as keys, cell phone, paperback book, etcetera when the sink and hand towels are to be used.

The present invention provides a dispenser that can be easily placed over a towel bar for use by guests to a home, and easily removed from the towel bar after the guests leave. The dispenser can be stored for a future gathering of guests, if there are remaining sheeted cleaning media, such as paper hand towels. Note that the dispenser goes where towels normally go, and does not take up counter-top space. It also does not require fasteners such as adhesives, straps, or screws to affix the dispenser to the towel bar. When not in use, the dispenser can be removed from the towel bar and the hangers placed within a cavity in the base section that attaches them to the container. The dispenser is then more suitable for storing. Additionally, attractive colors and designs may be printed or placed upon the container to make it esthetically pleasing for bathroom display.

Besides paper hand towels, the dispenser may dispense other forms of sheeted cleaning media, such as facial tissues and wipes. The sheeted cleaning media can be supplied either on a roll, or in an individually sheeted and folded form. The individually sheeted and folded form is presently preferred.

Further advantages of this invention will become apparent from a consideration of the drawings and ensuing description.

SUMMARY OF THE INVENTION

The present invention relates to a sheeted cleaning media dispenser that can be placed upon on a wall mounted towel bar within the home, and for use primarily by visiting guests. The invention is anticipated to have wide use as a paper hand towel dispenser for visiting guests to a residence.

BRIEF DESCRIPTION OF THE DRAWINGS

FIG. 4 shows a towel being dispensed from the container at an angle from the wall and the hanger limiting the rotation of the container by bumping up against the wall.

DETAILED DESCRIPTION OF THE PRESENTLY PREFERRED EMBODIMENTS

Figure 1:
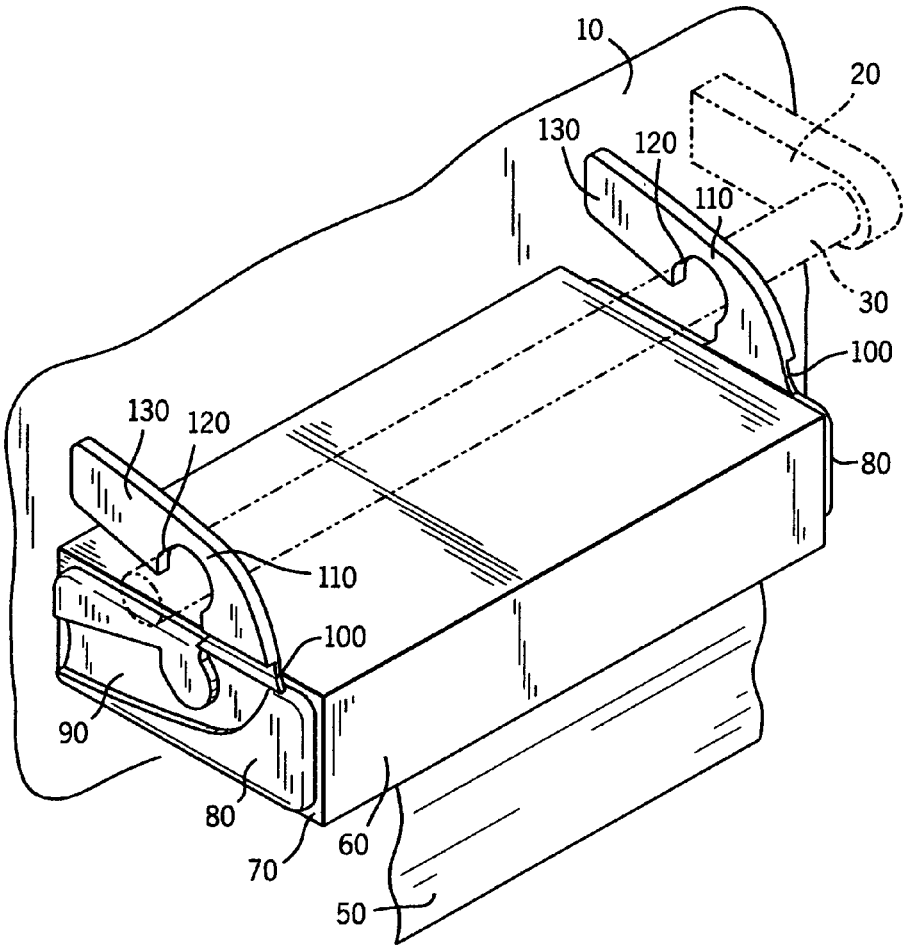
FIG. 1 is a perspective view of a presently preferred embodiment of the invention showing hangers that attach a container of sheeted cleaning media to a towel bar, and the hangers having an extended section to limit rotation of the container about the towel bar when sheeted cleaning media are dispensed.

FIG. 1 is a perspective view of a presently preferred embodiment of the invention showing hangers 110 in the up or open position and hung from a towel bar 30. A sheeted cleaning medium 50, such as a paper hand towel, is shown extending from the bottom of the container 60. The openings 120 shown in hangers 110 of the invention, show straight and curved sections to accommodate various standard towel bars whether they are of a square or round bar design. It should be noted that some "standard" towel bars, especially of the round bar design, may be placed at slightly different distances from a wall 10, as well as have different diameters of a bar. This is typically due to the type of bracket 20 that is used. The hanger openings 120 therefore may be an unusual shape—not fully rectangular or circular. The area 130 of each hanger 110 extends beyond the opening 120 for the towel bar 30 and comes near the wall 10 when the hangers 110 are hung, and the areas 130 limits rotation of the container 60 by bumping up against the wall 10 when a sheeted cleaning medium 50 is dispensed at an angle from the wall 10. Hangers 110 are shown rotatably attached to base sections 80 by hinge lines 100. Hangers 110 can be stored in a cavity 90 in their respective base section 80. And, the base sections 80 are attached to sidewalls 70 of container 60.

Figure 2:
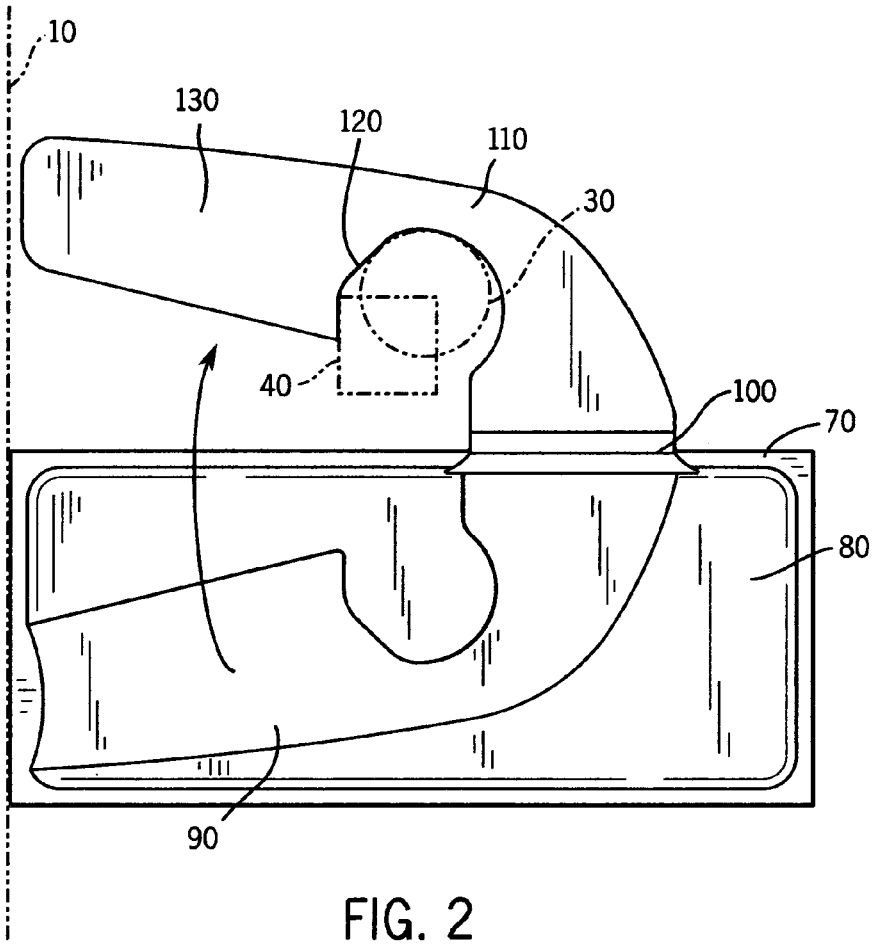
FIG. 2 is a plan view of the end of the dispenser shown in FIG. 1, showing a hanger, the base that the hanger is attached to, as well as how the dispenser hangs on common towel bars (two example towel bar cross-sections shown), and with the hanger extension and container in it's mounted position along side a wall.

FIG. 2 is a plan view of the end of container 60 (shown in FIG. 1) showing a hanger 110 and base section 80, with the hanger 110 in the up or open position as was shown in FIG. 1. The base 80 shows a cavity 90 where the hanger 110 would lay in the base 80 in the closed position. Hanger 110 rotates about the hinge line 100 to move in relation to the base 80 that is attached to a sidewall 70 of container 60 (shown in FIG. 1). An opening 120 in the hanger 110 is shown that accepts the most common types of towel bars, square 40 and round 30, and an area 130 of the hanger 110 extending from that opening 120 towards the wall 10, so that the area 130 may bump-up against the wall 10 to prevent rotation of the container 60 (shown in FIG. 1) during dispensing of a sheeted cleaning medium 50 (shown in FIG. 1).

Figure 3:
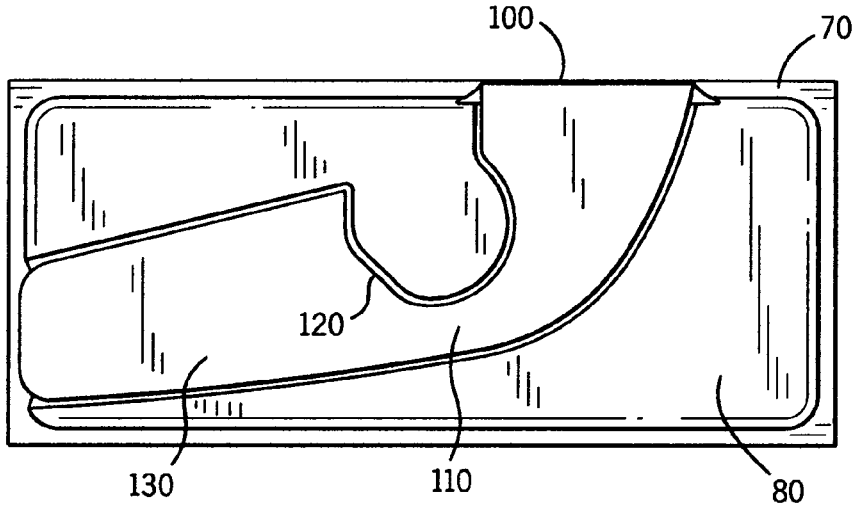
FIG. 3 is a plan view of the figure of FIG. 2 without the wall or example towel bars, and showing the hanger rotated about the hinge and placed within the cavity of the base section that is attached to the container sidewall.

FIG. 3 is a plan view of the end of container 60 (shown in FIG. 1), like FIG. 2, but showing the hanger 110 rotated about the hinge line 100 and laying within the base 80 that is fastened to a sidewall 70 of the container 60 (shown in FIG. 1). The area 130 of hanger 110 is now shown resting in the cavity 90 (as shown in FIG. 2), with a portion of the base 80 also taking up space of the hanger opening 120.

Figure 4:
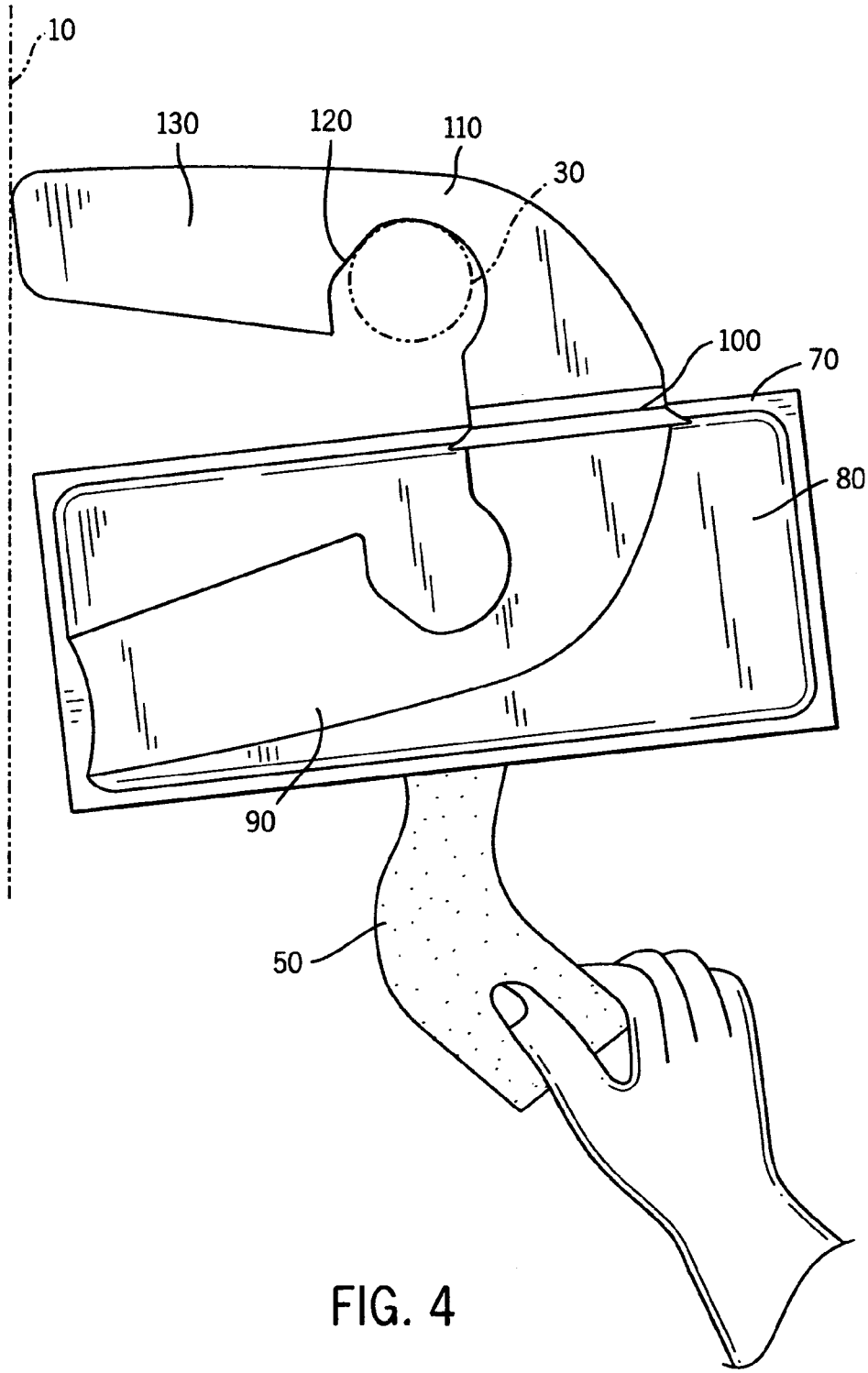
FIG. 4 is a plan view of the figure of FIG. 2 without the square towel bar example and without the arrow indicating the rotational direction of the hanger.

FIG. 4 is a plan view of the figure of FIG. 2 without the square towel bar 40 example and without the arrow indicating the rotational direction of the hanger 110 when it is removed from cavity 90. FIG. 4 shows the area 130 of the hanger 110 bumped up against the wall 10 to limit the rotation of the container 60 (shown in FIG. 1) as a towel 50 is dispensed from the container 60 (shown in FIG. 1) at an angle from the wall 10.

The container 60 shown in the presently preferred embodiment of the invention has a size of approximately 11¾ inches long, 5½ inches wide, and 2¾ inches deep. The depth dimension being determined by the height of the stack of sheeted cleaning media contained within the container.

While various embodiments of the invention have been disclosed and described herein, it may be apparent to those skilled in the art that various changes in form and detail may be made therein without departing from the spirit and scope thereof.

What is claimed is:

1. A dispenser of sheeted cleaning media comprising:

a container having sheeted cleaning media disposed within; and an openable hook shaped hanger that is attached to the container and when open has an extended area from a hanging area of the hook shaped hanger that provides an opening to the hanging area of the hook shaped hanger, the opening providing a means for the hook shaped hanger to be placed on a towel bar that is attached to a wall, the extended area being adjacent the wall when the hook shaped hanger is hanging on the towel bar, and as the sheeted cleaning media are dispensed at an angle from the wall from the container the extended area is in contact with the wall to limit the rotation of the container about the towel bar; and a base that is attached to a container side and being generally inset from the perimeter of a sidewall of the container, the base forming a cavity configured to match the perimeter shape of the openable hook shaped hanger, and the base extending from the sidewall comprising a depth to match the thickness of the openable hook shaped hanger.

2. The dispenser of claim 1 wherein the sheeted cleaning media are folded.

3. The dispenser of claim 1 wherein the openable hook shaped hanger is rotatably attached to the container.

4. The dispenser of claim 1 wherein the openable hook shaped hanger opening is irregular shaped and accepts most towel bars as are used in residential settings for bathroom hand towels.

5. The dispenser of claim 1 wherein the sheeted cleaning media are at least one of facial tissues and wipes.

6. The dispenser of claim 1 wherein the container has generally flat and rectangular shaped sides.

7. The dispenser of claim 1 wherein the sheeted cleaning media are paper hand towels.

8. The dispenser of claim 1 wherein the openable hook shaped hanger is made of at least one of paperboard, cardboard, and plastic.

9. The dispenser of claim 1 wherein the container is made of at least one of paperboard, cardboard, and plastic.

10. A dispenser of sheeted cleaning media comprising:

a container having sheeted cleaning media disposed within; and an openable hook shaped hanger that is attached to the container and when open has an extended area from a hanging area of the hook shaped hanger that provides an opening to the hanging area of the hook shaped hanger, the opening providing a means for the hook shaped hanger to be placed on a bar that is attached to a bathroom wall, the extended area being adjacent the bathroom wall when the hook shaped hanger is hanging on the bar, and as the sheeted cleaning media are dispensed at an angle from the bathroom wall from the container the extended area is in contact with the bathroom wall to limit the rotation of the container about the bar; and a base that is attached to a container side and being generally inset from the perimeter of a sidewall of the container, the base forming a cavity configured to match the perimeter shape of the openable hook shaped hanger, and the base extending from the sidewall comprising a depth to match the thickness of the openable hook shaped hanger.

11. The dispenser of claim 10 wherein the openable hook-shaped hanger is rotatably attached to the container.

12. The dispenser of claim 10 wherein the sheeted cleaning media are at least one of hand towels, facial tissues, and wipes.

13. The dispenser of claim 10 wherein the sheeted cleaning media are folded.

* * * * *